US011489307B1

(12) United States Patent
Cabañero

(10) Patent No.: US 11,489,307 B1
(45) Date of Patent: Nov. 1, 2022

(54) METHOD OF CRIMPING AN ELECTRICAL TERMINAL ONTO A FLAT FLEXIBLE CABLE

(71) Applicant: Lear Corporation, Southfield, MI (US)

(72) Inventor: Albert M. Cabañero, Cebu (PH)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/370,640

(22) Filed: Jul. 8, 2021

(51) Int. Cl.
*H01R 43/04* (2006.01)
*H01R 43/048* (2006.01)
*H01R 4/18* (2006.01)

(52) U.S. Cl.
CPC ..... *H01R 43/048* (2013.01); *H01R 4/182* (2013.01); *Y10T 29/49185* (2015.01)

(58) Field of Classification Search
CPC .... H01R 9/0518; H01R 13/28; H01R 43/048; H01R 4/023; H01R 12/77; H01R 13/50; H01R 43/04; H01R 4/10; H01R 4/18; Y10T 29/49185; Y10T 29/4987
USPC ..... 29/863, 753, 761, 857, 861, 867, 874, 29/882
See application file for complete search history.

(56) References Cited

U.S. PATENT DOCUMENTS

| | | | | |
|---|---|---|---|---|
| 3,920,303 | A | 11/1975 | Pillman et al. | |
| 5,308,262 | A | 5/1994 | Chishima | |
| 5,733,154 | A * | 3/1998 | Libregts | H01R 4/182 439/850 |
| 7,316,581 | B2 * | 1/2008 | Kumakura | H01R 4/182 439/877 |
| 7,354,308 | B2 | 4/2008 | Iwahori | |
| 10,103,454 | B2 | 10/2018 | Hanazaki | |
| 2016/0372854 | A1 | 12/2016 | Schmatz et al. | |
| 2019/0363487 | A1 | 11/2019 | Metzler | |
| 2020/0251845 | A1 | 8/2020 | Architekt et al. | |

* cited by examiner

*Primary Examiner* — Thiem D Phan
(74) *Attorney, Agent, or Firm* — MacMillan, Sobanski & Todd, LLC

(57) ABSTRACT

A method of attaching an electrical terminal to a flat flexible cable includes the step of deforming crimp wings on an electrical terminal to engage a flat flexible cable.

16 Claims, 8 Drawing Sheets

METHOD OF CRIMPING AN ELECTRICAL TERMINAL ONTO A FLAT FLEXIBLE CABLE

BACKGROUND OF THE INVENTION

This invention relates to an electrical terminal adapted for use with a flat flexible cable. More specifically, this invention relates to a method of crimping an electrical terminal onto a flat flexible cable.

A flat flexible cable is a type of electrical cable that includes a flat, flexible plastic base that support one or more flat electrical conductors thereon. Flat flexible cables are typically used in devices having a large amount of electronics in a relatively small space. In such devices, the flat flexible cable can provide for easier cable management than a conventional round electrical cable.

The electrical conductors on the flat flexible cable are typically connected to an electrical terminal in a connector, such as that disclosed in U.S. Pat. No. 5,308,262. As described therein, the conductor is pressed into engagement with the terminal. It would be advantageous to have an improved electrical terminal for attachment to a flat flexible cable.

SUMMARY OF THE INVENTION

The invention relates to a method of attaching an electrical terminal onto a flat flexible cable. The method includes the step of deforming crimp wings on an electrical terminal to engage a flat flexible cable.

In another embodiment, the method includes the step of providing an electrical terminal that has a crimp portion with first crimp wings and second crimp wings. The method also includes the step of providing a flat flexible cable. The method further includes the steps of deforming the first crimp wings to engage one layer of the flat flexible cable, bending the flat flexible cable over the first crimp wings, and deforming the second crimp wings to engage two layers of the flat flexible cable.

In another embodiment, the method includes the steps of positioning a fold guide between an electrical terminal and a flat flexible cable, moving a cable guide relative to the electrical terminal to move the flat flexible cable into engagement with the electrical terminal, deforming first crimp wings on the electrical terminal to engage the flat flexible cable, moving the fold guide relative to the electrical terminal to bend a portion of the flat flexible cable over the first crimp wings, and deforming second crimp wings on the electrical terminal to engage the bent portion of the flat flexible cable.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
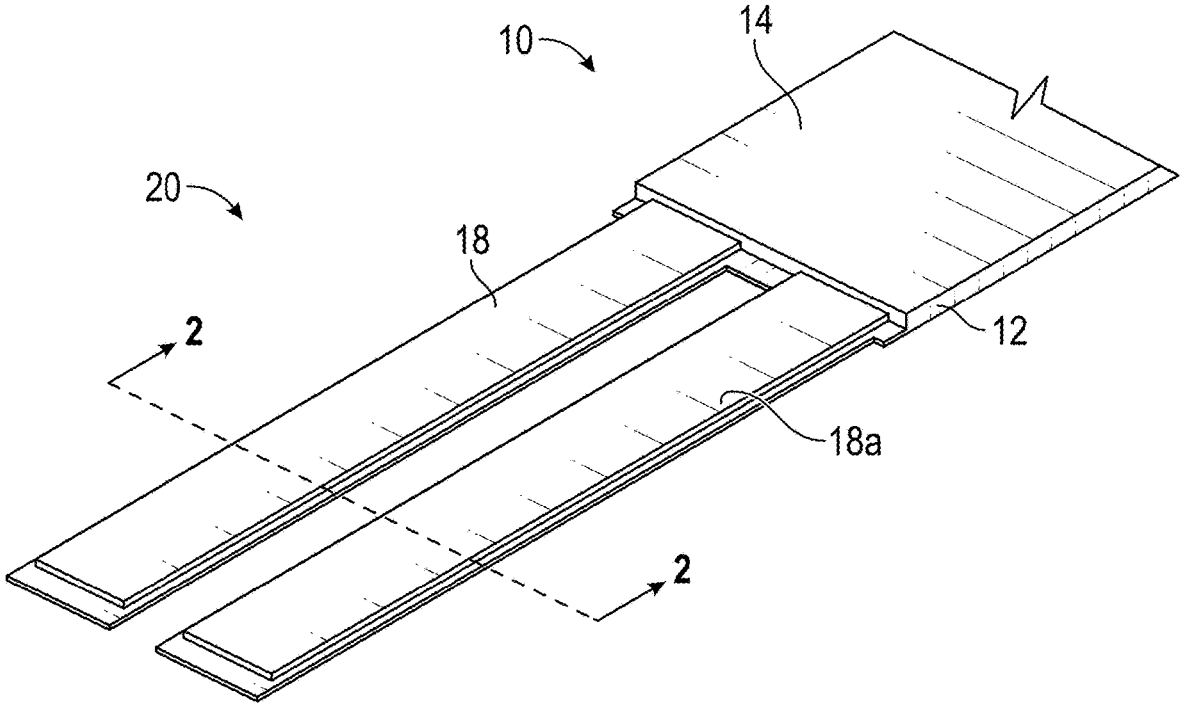
FIG. 1 (Prior Art)
FIG. 1 is a perspective view of a flat flexible cable that is conventional in the art.
Figure 2:
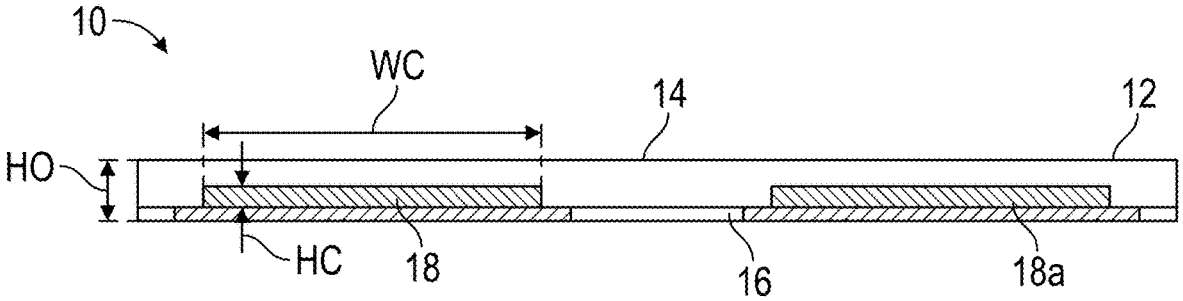
FIG. 2 (Prior Art)
FIG. 2 is a cross-sectional view taken along line 2-2 of FIG. 1.

Referring now to the drawings, there is illustrated in FIGS. 1 and 2 a flat flexible cable, indicated generally at 10, that is, of itself, conventional in the art. The flat flexible cable 10 includes an insulator 12. The illustrated insulator 12 is formed from a plastic material, but any desired material may be used. The insulator 12 includes a first face 14 and an opposed second face 16.

The flat flexible cable 10 also includes a flat flexible electrical conductor 18. The illustrated electrical conductor 18 is a thin, solid layer of copper that is bonded to or otherwise supported on the insulator 12, but may be any desired material. In the illustrated embodiment, the flat flexible cable 10 also includes a second electrical conductor 18*a*, and the insulator 12 surrounds the electrical conductors 18 and 18*a* along most of the length of the flat flexible cable 10. However, the flat flexible cable 10 may have any desired number of electrical conductors 18 in any desired arrangement. In the illustrated embodiment, the flat flexible cable 10 has a height HO of 0.35 mm. However, the flat flexible cable 10 may have any desired height. Additionally, the illustrated electrical conductor 18 has a height HC of 0.125 mm and a width WC of 2.05 mm, but may have any desired dimensions. The ratio of the height to the width of the electrical conductor 18 and the flat flexible cable 10 are significantly different from a typical round wire or a bundle of wires, which typically define an electrical conductor having a generally circular cross-section.

In the illustrated embodiment, the electrical conductors 18 and 18*a* have the same dimensions, but may have different dimensions.

The flat flexible cable 10 includes a stripped portion, indicated generally at 20, where portions of the electrical conductor 18 and the electrical conductor 18*a* are not covered by the insulator 12. As a result, those stripped portions 20 of the electrical conductor 18 and the electrical conductor 18*a* are exposed on the first face 14 of the flat flexible cable 10. The stripped portions 20 may be created by removing the portions of the insulator 12 that would otherwise cover the electrical conductors 18 and 18*a*.

Figure 3:
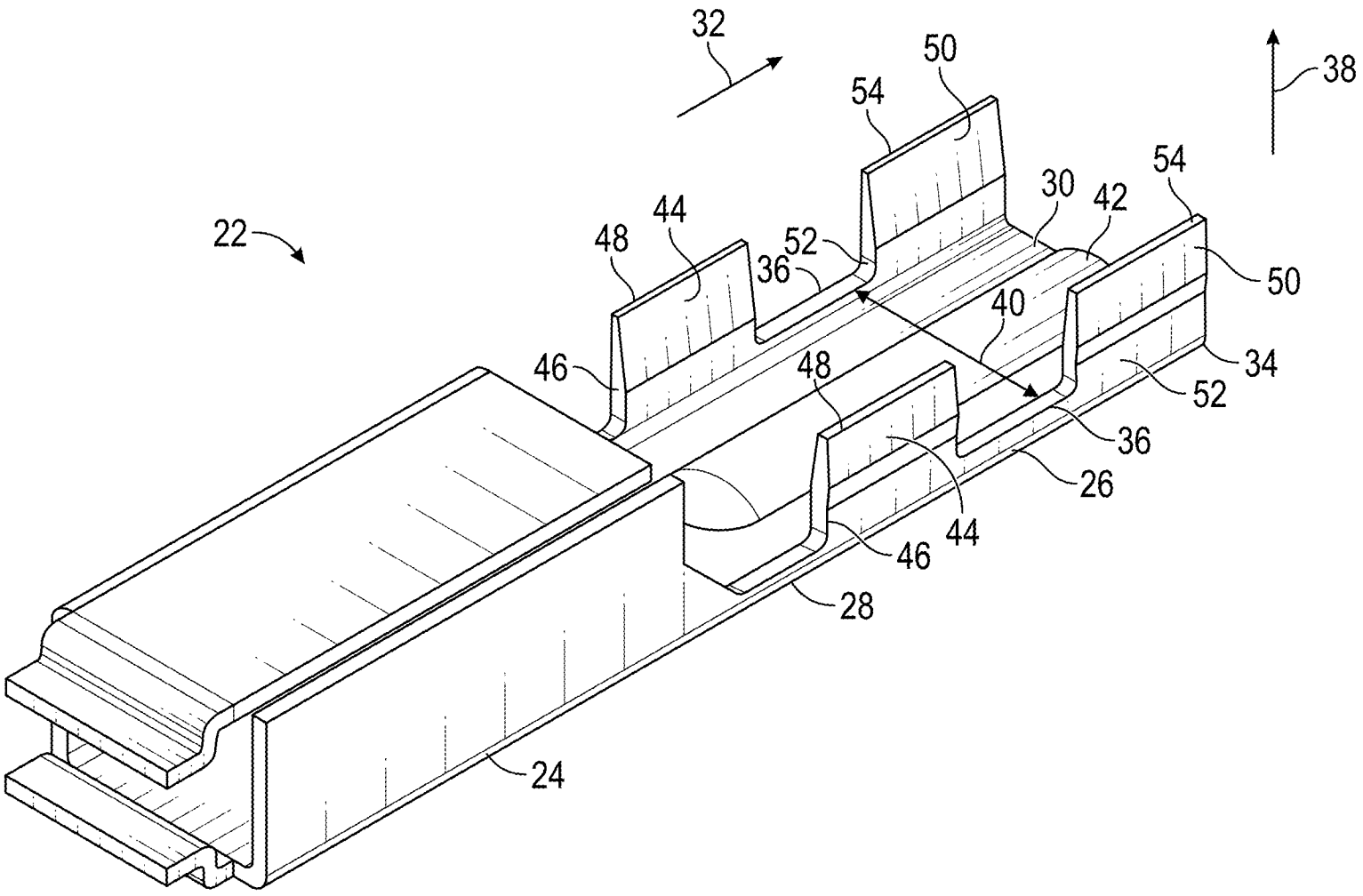
FIG. 3 is a perspective view of an electrical terminal that can be attached to the flat flexible cable shown in FIGS. 1 and 2 in accordance with the method of this invention.

Referring to FIG. 3, there is illustrated a perspective view of an electrical terminal, indicated generally at 22, in accordance with this invention that is adapted to be crimped to the flat flexible cable 10. The electrical terminal 22 is adapted to be crimped onto the conductor 18, as will be described below. The illustrated electrical terminal 22 is formed from a single piece sheet metal that is folded into the illustrated shape. However, the electrical terminal 22 may be made from any material and by any desired method. The electrical terminal 22 includes a contact portion 24 and a crimp portion 26. A transition portion 28 is located between the contact portion 24 and the crimp portion 26.

In the illustrated embodiment, the contact portion 24 is female, box-type contact that is adapted to engage a male blade terminal (not shown). However, the contact portion 24 may be any desired type of contact and adapted to engage any desired complementary contact.

The crimp portion 26 includes a crimp base 30. The crimp base 30 is generally flat and extends from the transition portion 28 in a first crimp direction 32 to a base end 34. Side walls 36 are located on opposite sides of the crimp base 30 and extend in a second crimp direction 38. The second crimp direction 38 is generally perpendicular to the crimp base 30 and also generally perpendicular to the first crimp direction 32. The crimp base 30 defines a generally uniform width 40 between the side walls 36 along its length. The illustrated crimp base 30 includes a raised region 42 that extends in the second crimp direction 38. The illustrated raised region 42 extends along a centerline defined by the crimp base 30 in the middle of the width 40 and extends from the transition portion 28 to the base end 34.

The crimp portion 26 includes two first crimp wings 44. The first crimp wings 44 are located on opposite sides of the crimp base 30 near the transition portion 28. Each of the first crimp wings 44 extends from one of the side walls 36 in the second crimp direction 38. Each of the first crimp wings 44 extends from a first wing base 46 to a first wing end 48. The first wing bases 46 are separated from each other by the width 40. Each of the first crimp wings 44 has a first length that is measured between the respective first wing base 46 and the first wing end 48.

The crimp portion 26 also includes two second crimp wings 50. The second crimp wings 50 are located on opposite sides of the crimp base 30 near the base end 34. Each of the second crimp wings 50 extends from one of the side walls 36 in the second crimp direction 38. Each of the second crimp wings 50 extends from a second wing base 52 to a second wing end 54. The second wing bases 52 are separated from each other by the width 40. Each of the second crimp wings 50 has a second length that is measured between the respective second wing base 52 and the second wing end 54. In the illustrated embodiment, the second length is substantially the same as the first length. However, the first length and the second length may have any desired values.

Figure 4:
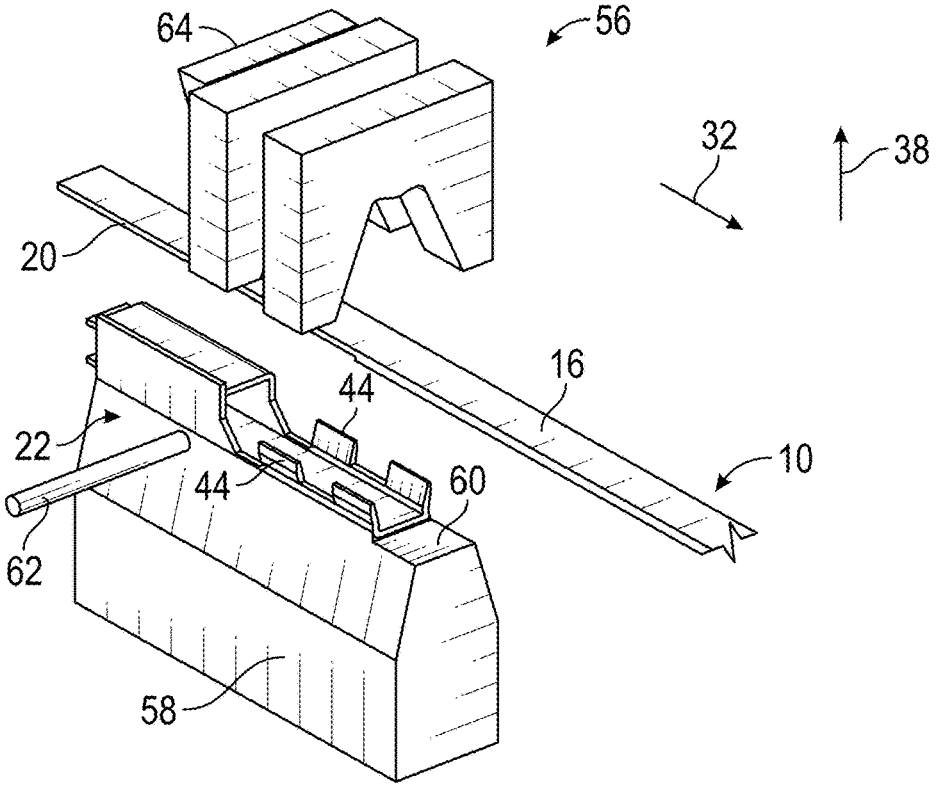
FIGS. 4-11 are perspective views of steps used in a crimping process to attach the flat flexible cable illustrated in FIG. 1 to the electrical terminal illustrated in FIG. 3.

Referring now to FIG. 4, there is illustrated a perspective view of a crimp tool, indicated generally at 56, that is adapted to attach the electrical terminal 22 to the flat flexible cable 10. The crimp tool 56 may be operated manually by an operator, mechanically by a press, or in any other desired manner. The operation of the crimp tool 56 will be explained in reference to FIGS. 4-11.

The crimp tool 56 includes a die 58 with a die surface 60. The die surface 60 is substantially flat, and the electrical terminal 22 is initially positioned on the die surface 60. The flat flexible cable 10 is initially positioned with the stripped portion 20 located in the second crimp direction 38 from the crimp base 30.

Figure 5:
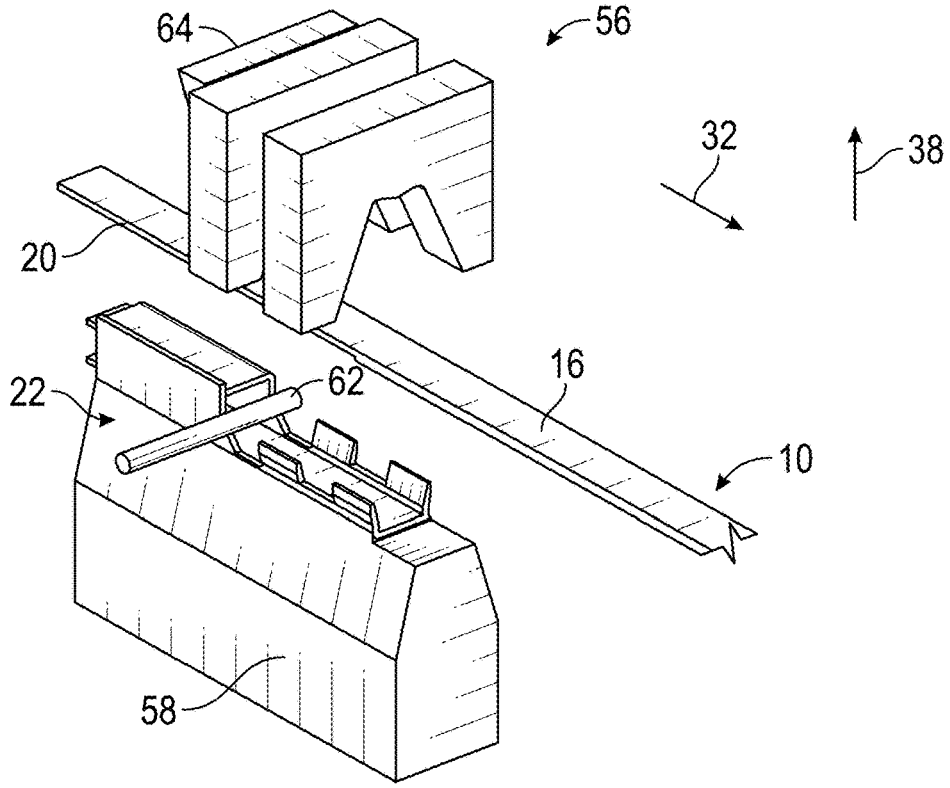

The crimp tool 56 includes a fold guide 62. The illustrated fold guide 62 is a cylindrical prism, but may have any desired shape. The fold guide 62 is shown in a first guide position in FIG. 4, wherein the fold guide 62 is located to allow the electrical terminal 22 to be placed on the die surface 60. In FIG. 5, the fold guide 62 is shown moved relative to the die 58 to a second guide position, wherein the fold guide 62 is located in the second crimp direction 38 from the transition portion 28 between the transition portion 28 and the flat flexible cable 10.

Figure 6:
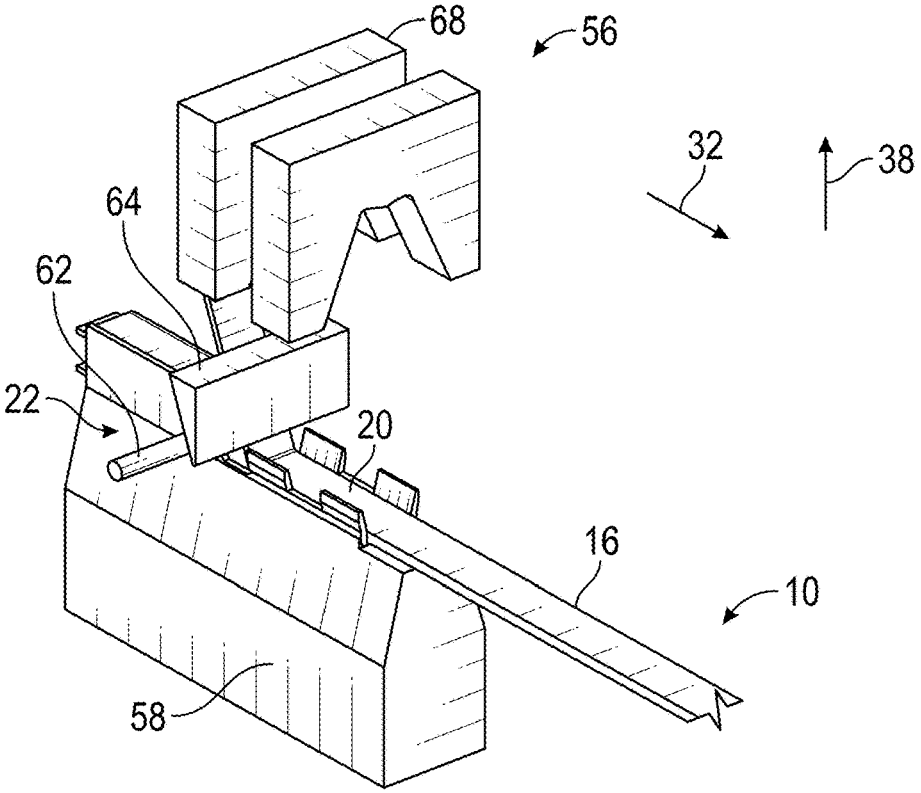

The crimp tool 56 also includes a cable guide 64. The cable guide 64 is shown in a first cable guide position in FIG. 5. As shown in FIG. 6, the cable guide 64 is adapted to be moved in a direction opposite the second crimp direction 38 relative to the die 58. As a result, the cable guide 64 moves the flat flexible cable 10 in the same direction onto the crimp portion 26 of the electrical terminal 22, where an area of the stripped portion 20 is located adjacent to the crimp base 30. Additionally, when the flat flexible cable 10 is moved from the initial position toward the electrical terminal 22, the flat flexible cable 10 engages the fold guide 62, which causes a bent portion 66 of the flat flexible cable 10 to be deflected away from the electrical terminal 22.

Figure 7:
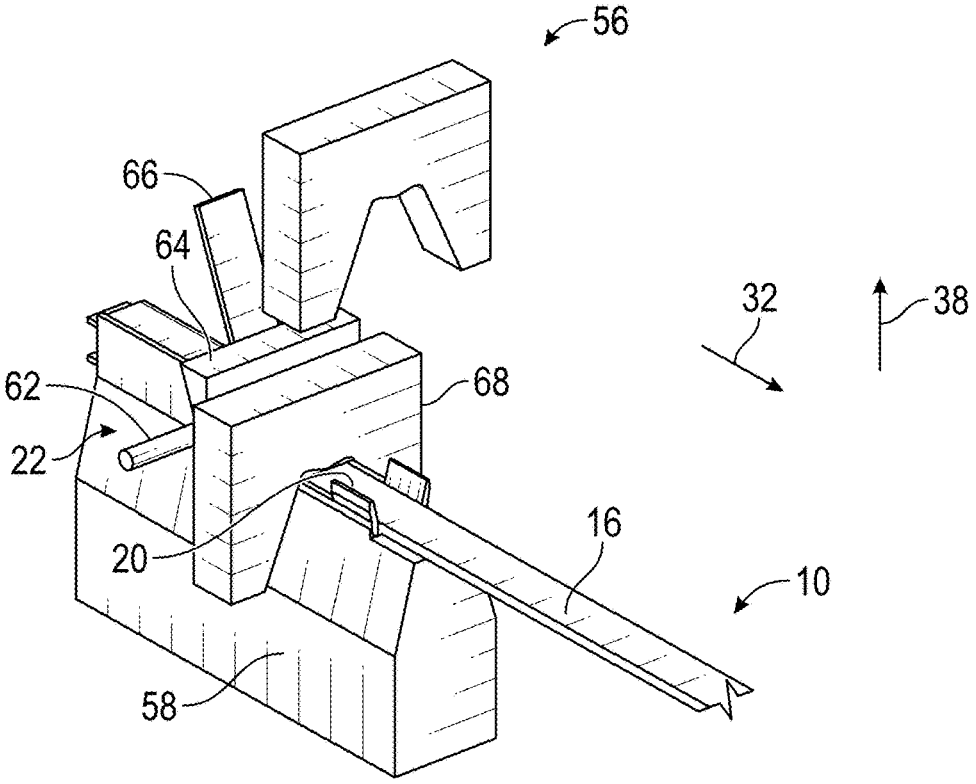
Figure 8:
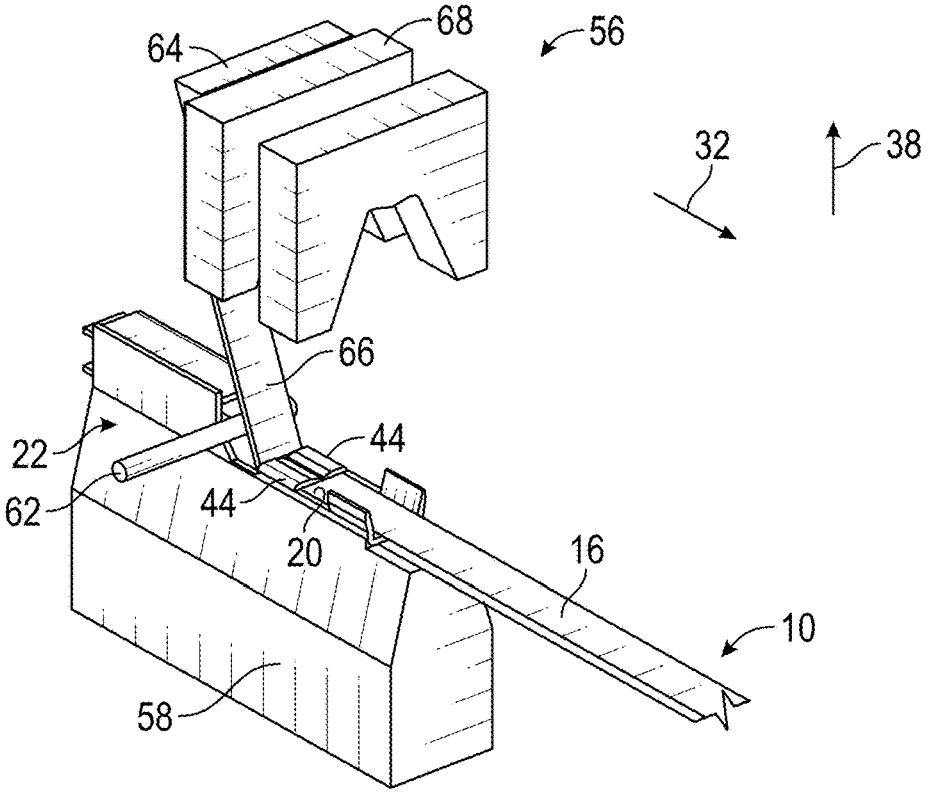

The crimp tool 56 includes a first punch 68. As shown in FIG. 7, while the cable guide 64 holds the flat flexible cable 10 in position relative to the electrical terminal 10, the first punch 68 is moved in the direction opposite the second crimp direction 38 relative to the die 58 into engagement with the first crimp wings 44. Referring to FIG. 8, the cable guide 64 and the first punch 68 are then moved in the second crimp direction 38 relative to the die 58. The first crimp wings 44 are visible in their respective crimped positions in FIG. 8. As shown, the first crimp wings 44 are deformed so that the first wing end 48 of each first crimp wing 44 is moved toward the center of the crimp base 30. The first crimp wings 44 engage the second face 16 of the flat flexible cable 10 and press the flat flexible cable 10 against the crimp base 30.

Figure 9:
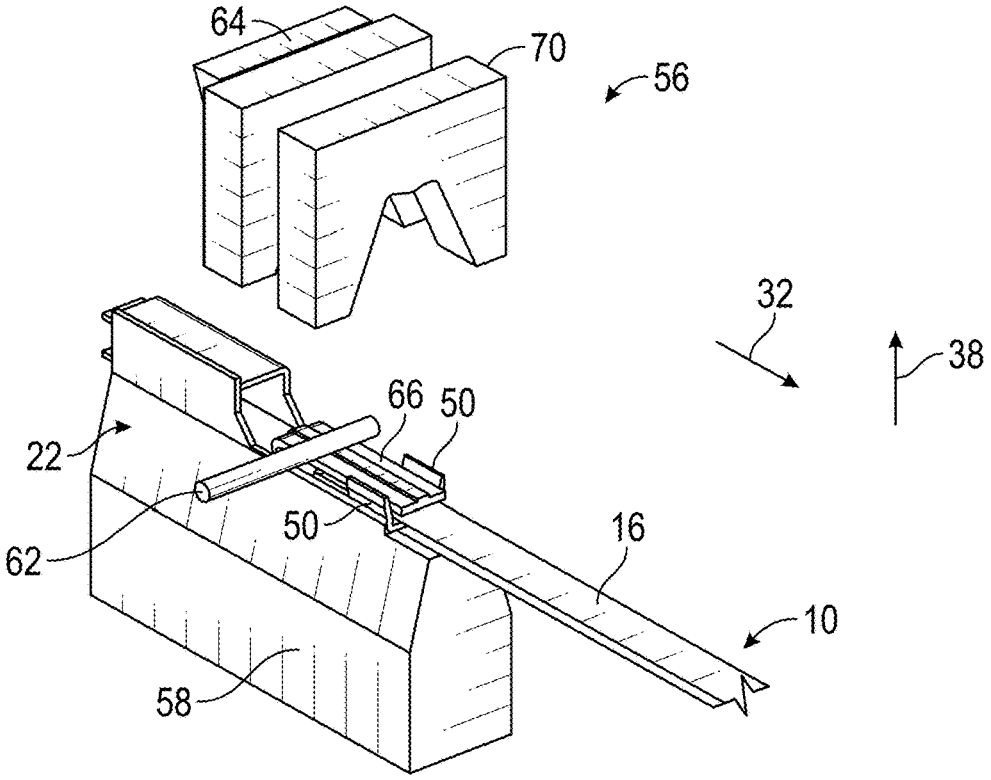

Referring to FIG. 9, the fold guide 62 is then moved in the first crimp direction 32 relative to the die 58. The fold guide 62 is adapted to engage the bent portion 66 of the flat flexible cable 10 and move it relative to the electrical terminal 22. As shown, the second face 16 of the bent portion 66 engages the second face 16 of the part of the flat flexible cable 10 that is engaged with the crimp base 30.

Figure 10:
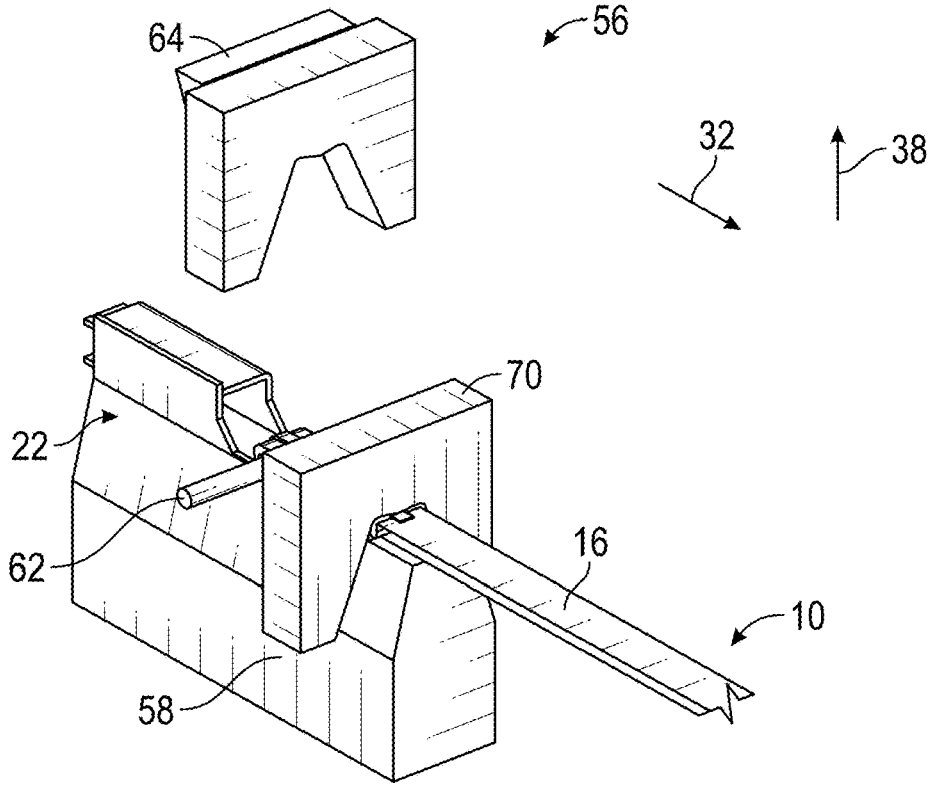
Figure 11:
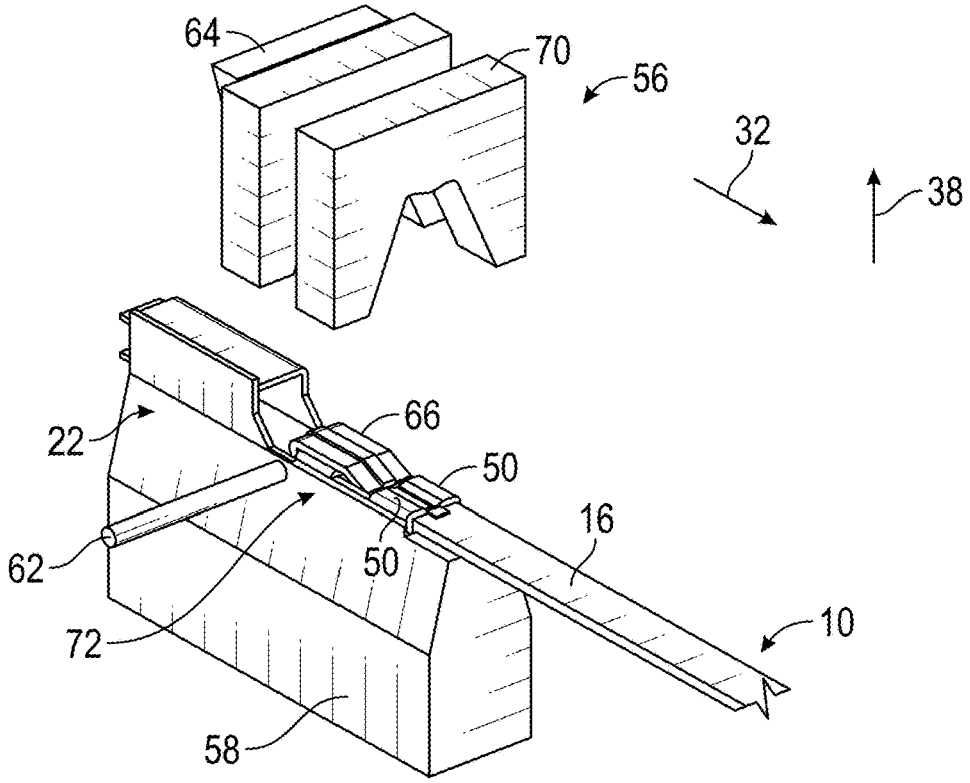

The crimp tool 56 also includes a second punch 70. As shown in FIG. 10, the second punch 70 is moved in the direction opposite the second crimp direction 38 relative to the die 58 into engagement with the second crimp wings 50. Referring to FIG. 11, the second punch 70 is then moved in the second crimp direction 38 relative to the die 58. The second crimp wings 50 are visible in their respective crimped positions in FIG. 11. As shown, the second crimp wings 50 are deformed so that the second wing end 54 of each second crimp wing 50 is moved toward the center of the crimp base 30. The second crimp wings 50 engage the first face 14 of the bent portion 66 of the flat flexible cable 10 and press the flat flexible cable 10 against the crimp base 30.

Also shown in FIG. 11, the fold guide 62 is moved relative to the die 58 to its initial position. This allows the electrical terminal 22 with the completed crimp, indicated generally at 72, to be removed from the crimp tool 56.

Figure 12:
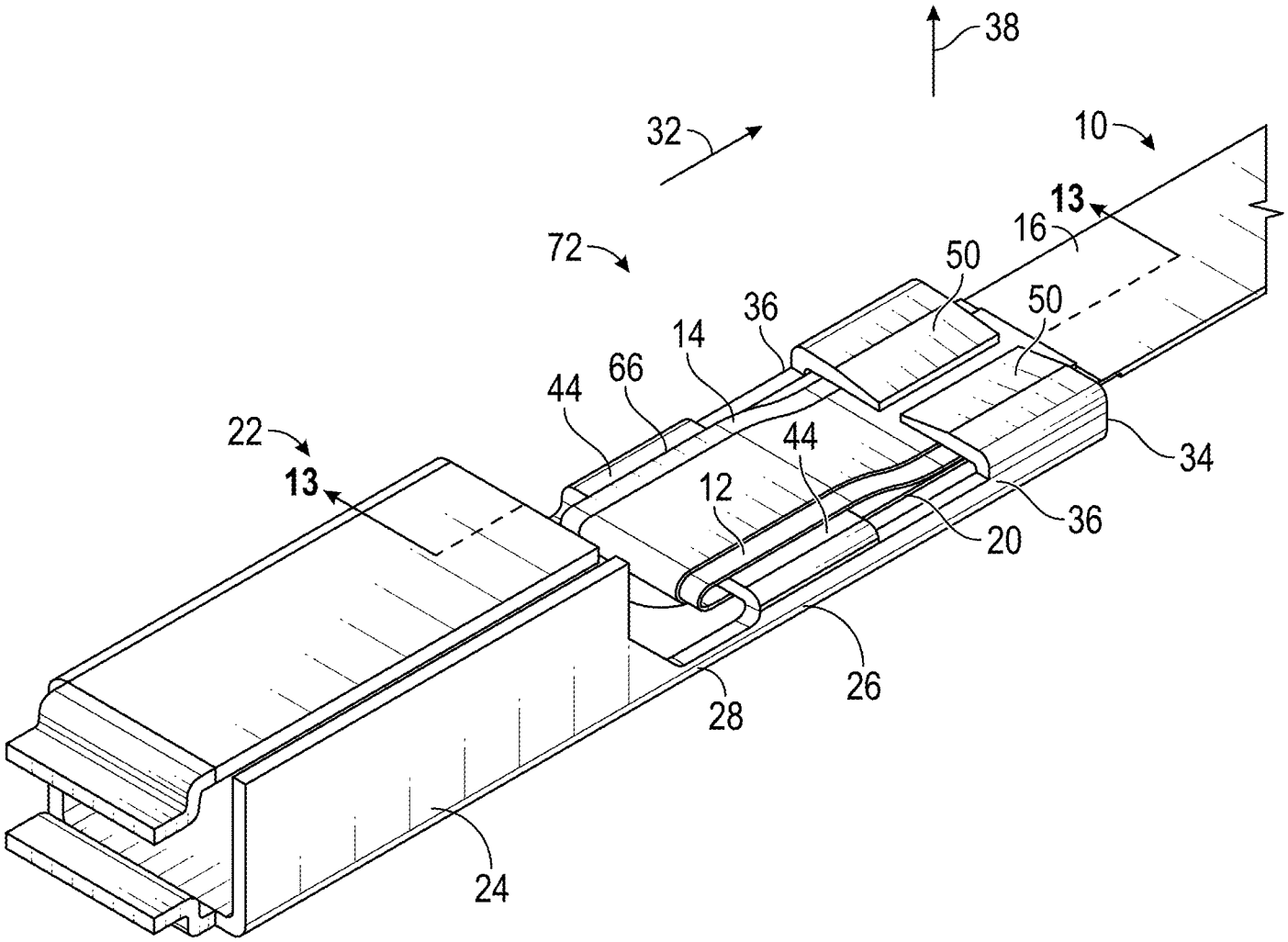
FIG. 12 is a perspective view similar to FIG. 3 showing the electrical terminal attached to the flat flexible cable from FIG. 1.
Figure 13:
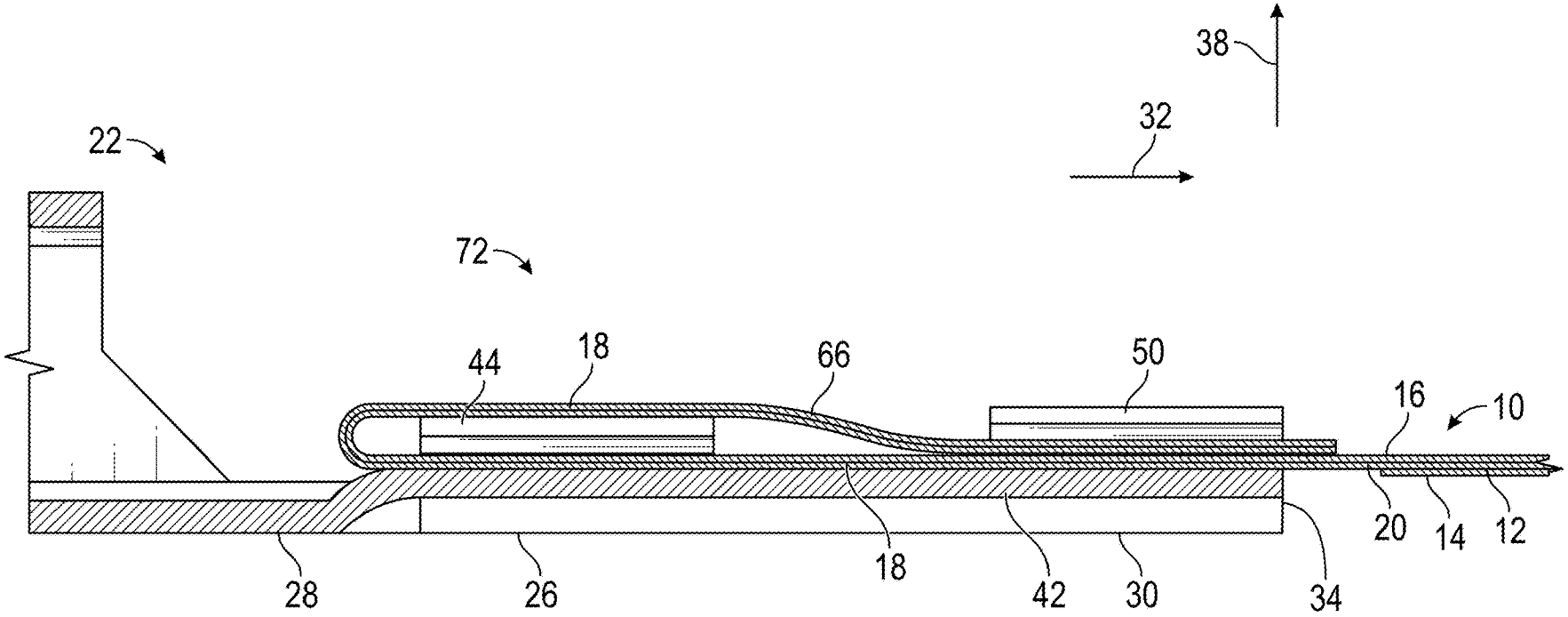
FIG. 13 is a cross-sectional view taken along line 13-13 of FIG. 12.

Referring to FIG. 12, there is illustrated a perspective view similar to FIG. 3, showing the flat flexible cable 10 attached to the electrical terminal 22 by the crimp 72. FIG. 13 is a cross-sectional view taken along the line 13-13, through the crimp 72.

As shown, the conductor 18 engages the crimp base 30. The conductor 18 engages the raised region 42 and is pressed against the raised region 42 by the first crimp wings 44 and the second crimp wings 50. Additionally, the stripped portion 20 of the flat flexible cable 10 is located between the first crimp wings 44 and the crimp base 30, and the first crimp wings 44 are located between the bent portion 66 of the flat flexible cable 10 and the crimp base 30. Further, the stripped portion 20 and the bent portion 66 of the flat flexible cable 10 are located between the second crimp wings 50 and the crimp base 30. Thus, in the crimp 72, the flat flexible cable 10 is looped around the first crimp wings 44 and is caught by the second crimp wings 50. This increases the strength of the connection between the flat flexible cable 10 and the electrical terminal 22 and so the flat flexible cable 10 is more difficult to pull out of the electrical terminal 10.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A method of attaching an electrical terminal to a flat flexible cable comprising the steps of:

(a) providing an electrical terminal including a first crimp wing and a second crimp wing;

(b) providing a flat flexible cable having a first portion and a second portion;

(c) deforming the first crimp wing into engagement with the first portion of the flat flexible cable;

(d) deforming the second portion of the flat flexible cable over the first crimp wing; and (e) deforming the second crimp wing into engagement with the second portion of the flat flexible cable.

2. The method defined in claim 1 wherein:

step (a) is performed by providing an electrical terminal including a pair of first crimp wings and the second crimp wing; and step (c) is performed by deforming each of the pair of first crimp wings into engagement with the first portion of the flat flexible cable.

3. The method defined in claim 1 wherein:

step (a) is performed by providing an electrical terminal including the first crimp wing and a pair of second crimp wings; and step (e) is performed by deforming each of the pair of second crimp wings into engagement with the second portion of the flat flexible cable.

4. The method defined in claim 1 wherein:

step (a) is performed by providing an electrical terminal including a pair of first crimp wings and a pair of second crimp wings;

step (c) is performed by deforming each of the pair of first crimp wings into engagement with the first portion of the flat flexible cable; and step (e) is performed by deforming each of the pair of second crimp wings into engagement with the second portion of the flat flexible cable.

5. The method defined in claim 1 wherein:

step (a) is performed by further providing the electrical terminal with a raised region; and step (c) is performed by deforming the first crimp wing such that the first portion of the flat flexible cable engages the raised region of the electrical terminal.

6. The method defined in claim 1 wherein:

step (a) is performed by further providing the electrical terminal with a raised region; and step (e) is performed by deforming the second crimp wing such that the second portion of the flat flexible cable engages the raised region of the electrical terminal.

7. The method defined in claim 1 wherein:

step (a) is performed by further providing the electrical terminal with a raised region;

step (c) is performed by deforming the first crimp wing such that the first portion of the flat flexible cable engages the raised region of the electrical terminal; and step (e) is performed by deforming the second crimp wing such that the second portion of the flat flexible cable engages the raised region of the electrical terminal.

8. The method defined in claim 1 wherein:

step (d) is performed by deforming the second portion of the flat flexible cable over the first crimp wing such that the second portion of the flat flexible cable is disposed adjacent to the first portion of the flat flexible cable; and step (e) is performed by deforming the second crimp wing to engage the adjacent first and second portions of the flat flexible cable.

9. A method of attaching an electrically conductive terminal to an electrically conductive cable comprising the steps of:

(a) providing an electrically conductive terminal including a first crimp wing and a second crimp wing;

(b) providing an electrically conductive cable having a first portion and a second portion;

(c) deforming the first crimp wing into engagement with the first portion of the electrically conductive cable;

(d) deforming the second portion of the electrically conductive cable over the first crimp wing; and (e) deforming the second crimp wing into engagement with the second portion of the electrically conductive cable.

10. The method defined in claim 9 wherein:

step (a) is performed by providing an electrical terminal including a pair of first crimp wings and the second crimp wing; and step (c) is performed by deforming each of the pair of first crimp wings into engagement with the first portion of the flat flexible cable.

11. The method defined in claim 9 wherein:

step (a) is performed by providing an electrical terminal including the first crimp wing and a pair of second crimp wings; and step (e) is performed by deforming each of the pair of second crimp wings into engagement with the second portion of the flat flexible cable.

12. The method defined in claim 9 wherein:

step (a) is performed by providing an electrical terminal including a pair of first crimp wings and a pair of second crimp wings;

step (c) is performed by deforming each of the pair of first crimp wings into engagement with the first portion of the flat flexible cable; and step (e) is performed by deforming each of the pair of second crimp wings into engagement with the second portion of the flat flexible cable.

13. The method defined in claim 9 wherein:

step (a) is performed by further providing the electrical terminal with a raised region; and step (c) is performed by deforming the first crimp wing such that the first portion of the flat flexible cable engages the raised region of the electrical terminal.

14. The method defined in claim 9 wherein:

step (a) is performed by further providing the electrical terminal with a raised region; and step (e) is performed by deforming the second crimp wing such that the second portion of the flat flexible cable engages the raised region of the electrical terminal.

15. The method defined in claim 9 wherein:

step (a) is performed by further providing the electrical terminal with a raised region;

step (c) is performed by deforming the first crimp wing such that the first portion of the flat flexible cable engages the raised region of the electrical terminal; and step (e) is performed by deforming the second crimp wing such that the second portion of the flat flexible cable engages the raised region of the electrical terminal.

16. The method defined in claim 9 wherein:

step (d) is performed by deforming the second portion of the flat flexible cable over the first crimp wing such that the second portion of the flat flexible cable is disposed adjacent to the first portion of the flat flexible cable; and step (e) is performed by deforming the second crimp wing to engage the adjacent first and second portions of the flat flexible cable.

* * * * *